United States Patent [19]

Haack

[11] Patent Number: 5,007,264

[45] Date of Patent: Apr. 16, 1991

[54] METHOD AND APPARATUS FOR THE BENDING OF WORKPIECES

[75] Inventor: Johannes Haack, Lyss, Switzerland

[73] Assignee: Feintool International Holding, Lyss, Switzerland

[21] Appl. No.: 269,192

[22] Filed: Nov. 9, 1988

[30] Foreign Application Priority Data

Nov. 19, 1987 [DE] Fed. Rep. of Germany ..... 3739173

[51] Int. Cl.[5] ..... B21D 5/04

[52] U.S. Cl. ..... 72/10; 72/320; 72/322; 72/387; 72/702; 72/37; 72/326

[58] Field of Search ..... 72/10, 9, 12, 21, 702, 72/319, 320, 321, 322, 323, 304, 306, 308, 416, 387, 309, 37, 326

[56] References Cited

U.S. PATENT DOCUMENTS

| | | | |
|---|---|---|---|
| Re. 31,938 | 7/1985 | Klukon | 72/387 |
| 3,352,136 | 11/1967 | Clarke | 72/702 |
| 3,440,847 | 4/1969 | Giordano | 72/12 |
| 4,446,710 | 5/1984 | Sallnert et al. | 72/10 |
| 4,524,599 | 6/1985 | Bailey | 72/321 |
| 4,564,765 | 1/1986 | Blaich | 72/389 |
| 4,598,568 | 7/1986 | Stadler | 72/320 |
| 4,802,357 | 2/1989 | Jones | 72/702 |

FOREIGN PATENT DOCUMENTS

| | | | |
|---|---|---|---|
| 0166351 | 1/1986 | European Pat. Off. | 72/702 |
| 3643190 | 6/1988 | Fed. Rep. of Germany | 72/702 |
| 0174221 | 10/1980 | Japan | 72/34 |
| 0082119 | 5/1984 | Japan | 72/702 |
| 00633174 | 4/1986 | Japan | 72/389 |
| 0229421 | 10/1986 | Japan | 72/702 |
| 0232018 | 10/1986 | Japan | 72/702 |

*Primary Examiner*—David Jones

*Attorney, Agent, or Firm*—Bachman & LaPointe

[57] ABSTRACT

In a method for the bending of workpieces by swivel bending jaws, the bent-off part is to assume a predetermined bending angle with respect to the workpiece, for this purpose, in a first bending operation, at least one corresponding leg is to be bent off from the workpiece by means of the swivel bending jaws. Then, the swivel bending jaws are released from the leg and a springback of the leg or the actual bending angle is determined by direct measurements and compared with a set bending angle. Subsequently, an agreement is established between set bending angle and actual bending angle by a renewed bending operation, by a bending-over.

28 Claims, 6 Drawing Sheets

METHOD AND APPARATUS FOR THE BENDING OF WORKPIECES

BACKGROUND OF THE INVENTION

The invention relates to a method for the bending of workpieces by swivel bending jaws, the bent-off part assuming a predetermined bending angle with respect to the workpiece, as well as an apparatus for this.

In many areas of application, it is necessary to bend off a certain region at a certain angle from a previously worked or unworked workpiece. A known conventional bending method works with a bending punch and a platen, between which the workpiece is held. Bending punch and platen then move together with the workpiece past a bending jaw, the projecting part of the workpiece being bent off by the bending radius of the bending punch.

A particularly disadvantageous aspect of this bending method is that a workpiece is bent off into a fixed gap. Furthermore, when the workpiece meets the bending jaw, a zone occurs on the workpiece in which material is displaced. Furthermore, the bending gap must be precisely determined in order for a correct bending to be performed. Workpiece thickness tolerances cannot be taken into account. A possible springback of the bent-off part after release from the bending punch and platen cannot be counteracted.

In many areas of application, however, an absolutely precise bending angle is just what is required. Therefore, to compensate for the springback, the so-called Rotax method has been developed. A description of this method is to be found in European Patent Application 0,155,228. The workpiece to be bent is placed onto two spaced apart jaws, which can turn about their longitudinal axis. In the space between the two jaws, a bending punch acts on the workpiece, so that the latter is bent off with simultaneous turning of the rotary jaws about their longitudinal axis without their own drive. After reaching a predetermined bending angle, the bending punch is raised again and the angle at which the surfaces of the two bending jaws are to each other is measured. This angle is then used to conclude the actual set angle. If this does not coincide with the set bending angle, the bending punch is lowered once again and the workpiece is correspondingly bent over. However, no absolutely accurate measurement of the bending angle actually achieved is possible by this indirect measurement. If, for example, the surfaces of the bending jaws have remainders of dirt adhering to them, these falsify the result from which the actual bending angle is concluded.

Furthermore, likewise only a bending in one operation is possible by this method.

Furthermore, it must be taken into account when bending a material that materials of the widest variety of strengths, material microstructures and cross-sections have to be worked. Depending on these parameters, the springback under bending is also different to a certain extent. Both material thickness tolerances and strength variations change the bending angle by different springback and parts which are not dimensionally true result.

The inventor has set himself the object of developing a method and apparatus of the abovementioned type by means of which bending angles can be produced independently of the strength, the material microstructure or the thickness of the workpiece in closest tolerance ranges, several bendings being performed simultaneously in one operation on one workpiece.

SUMMARY OF THE INVENTION

It leads to the achievement of this object that, in a first bending operation, at least one corresponding leg is bent off from the workpiece by means of the swivel bending jaw, then the swivel bending jaw is released from the leg and a springback of the leg or the actual bending angle produced is determined by direct measurement and compared with a set bending angle and subsequently an agreement between set bending angle and actual bending angle is established by a renewed bending operation by a bending-over.

So, in contrast to the Rotax method, the angular position of the surfaces of the rotary jaws is not used to conclude the actual bending angle, instead this actual bending angle is measured directly. For this purpose, in the case of a corresponding apparatus according to the invention, a bending anvil and a bending punch are assigned at least one swivel bending jaw, bending anvil and bending punch holding the workpiece between them. Consequently, the one plane for determining the bending angle is unequivocally fixed. In the bending punch and/ or in the bending anvil there is, however, at least one means for determining the bending angle. This means consists preferably of a measuring pin, which can be led against a bent-off leg of the workpiece. As this measuring pin, or its position, is precalibrated, when it meets the bent-off leg it indicates the bending angle very accurately.

In the method according to the invention, the measured actual bending angle is then fed to a computer and compared there with the set bending angle. In this case, the computer has a corresponding program for the widest variety of materials, via which a determining of the degree of bending-over in a second bending operation is performed. In practice it has been found that, with this second bending operation, it is already possible to bend to within the smallest tolerances. Where still greater accuracies are necessary, a remeasurement of the bending angle can once again be performed and this is corrected once again in a third bending operation.

Furthermore, it should prove favorable to carry out the first bending operation only up to the bending angle which corresponds to the desired set bending angle. If, namely, a bending-over were to take place as early as in the first bending operation and the springback failed to happen to the extent previously assumed, a correction of this bending-over could only be performed manually.

It is particularly advantageous that a recording of the actual bending angle can be performed by the computer and that this recording is also given to the corresponding workpiece as a control card.

In a further improved embodiment of the method, it is provided that, along with the bending-off of legs from the workpiece before or during the first bending operation, additionally further sections are bent off from the workpiece. In this way, it is possible for example to produce gearshift forks for motor vehicles in one operation, the bent-off legs having the receiving boreholes for corresponding bolts or rods lying absolutely in one axis. Tilting effects are consequently avoided with certainty.

This described method allows punched parts of any shape to be produced with bendings in one operation which are dimensionally absolutely correct.

BRIEF DESCRIPTION OF THE DRAWINGS

Further advantages, features and details of the invention emerge from the following description of preferred exemplary embodiments and with reference to the drawings, in which.

DETAILED DESCRIPTION

Figure 1:
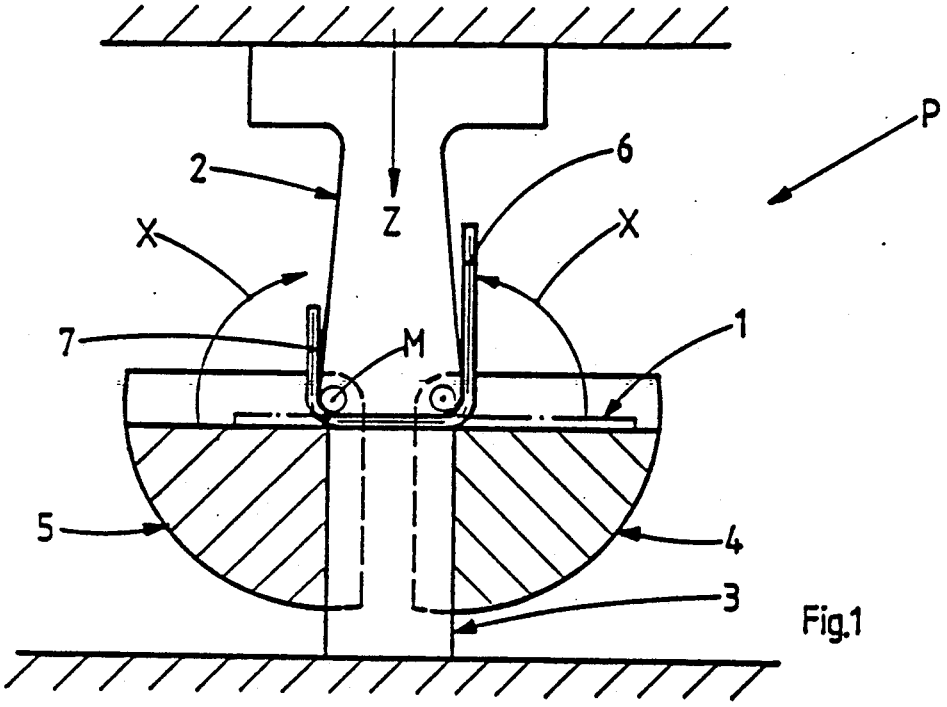
FIG. 1 shows a partially sectioned diagrammatic representation of the front view of an apparatus according to the invention for the bending of workpiece.

The workpieces may consist of all possible materials, the only requirement being that they are bendable. In the case of steel parts, bending is also successful in the hardened state.

In a preferred embodiment of the invention, the movement of the measuring pin is detected by a corresponding measuring probe. These measuring probes are commercially available and are therefore not to be described in more detail. For example, an angle lever, which pivots about a corresponding axis, may be arranged between measuring pin and measuring probe, acting with one leg on, for example, a pushbutton of the measuring probe, while its other leg is acted upon by the measuring pin. In order to ensure the intimate contact between leg and measuring pin, it has proved advisable to support this leg at the other end of the measuring pin against a spring.

The means described above for determining the bending angle are only intended to be by way of example. Contactless measuring sensors or the like are also conceivable. The arrangement and number of means for determining the bending angle are also not to be set any limit. If, for example, one leg of the workpiece is to be bent downward, i.e. toward the bending anvil, and another leg is to be bent upward, i.e. toward the bending punch, it is advisable to arrange one means in the bending punch and the other in the bending anvil. In order to ensure a bending-over, it may be necessary to design bending anvil and/or bending punch conically.

This actual centerpiece of the apparatus for the bending of workpieces is provided as a single press or else as a working stage in a progressive composite tool or as a working stage in a transfer press tool set. In this case, the press may be a C-frame press or else an O-frame press.

In any case, it has proved favorable to arrange bending punch and bending anvil together with the swivel bending jaws in a post jig. In this arrangement, the bending punch hangs, possibly with a rest interposed, on a raiseable and lowerable block, which is in turn guided via guide bushes on guide posts. This block is then acted upon by a corresponding ram of a hydraulic system.

The swivel bending jaws are also correspondingly designed within the scope of the invention. Each swivel bending jaw has a jaw body, which turns about an axis. In this case, the axis is formed partly by corresponding stub shafts, by which the swivel bending jaw is held in corresponding bearings.

For swivelling of the swivel bending jaw, one idea is to couple at least one of the stub shafts to a drive via a corresponding gear. This drive may, for example, consist of an electrohydraulic torque amplifier, which is commercially available and generally includes a hydraulic motor, an NC valve, a control slide valve and a pilot motor.

Another possibility is that the stub shaft is connected to an electrohydraulic linear amplifier, which is likewise commercially available and generally consists of a hydraulic cylinder, an NC valve and a pilot motor. Out of the hydraulic cylinder, a piston rod leads into a connecting link of a lever gear and acts via a corresponding lever on the axis or the stub shaft.

In a further exemplary embodiment of the invention, the idea is, however, that the jaw body is acted upon directly by an electrohydraulic linear amplifier, its piston rod being connected, for example, jointedly to a bolt on the jaw body. Since this bolt executes a circular movement, the cylinder should be mounted in a swivelling manner in a swivel bearing.

Of course, for some applications, in which no high bending force has to be applied, there is also the idea of connecting the stub shaft directly to an electrically operating stepping motor.

Depending on the application, it will prove advisable to provide each swivel bending jaw with a corresponding drive, or else to couple only one swivel bending jaw to a drive and to establish the connection to the other swivel bending jaw via corresponding gear elements. Here too, the scope of the invention is set no limit.

The jaw body of the swivel bending jaw is preferably to consist of two lateral supports, which form between them a guide surface. In this case, the guide surface is arranged in a lowered position between two supports and thus forms a receiving channel for the leg to be bent of the workpiece. The inner edge of this guide surface also lies outside the turning axis of the swivel bending jaw, so that, during bending of the leg, the guide surface rests flush against the latter and, for example, no material displacement takes place by using a bending edge.

Moreover, the guide surface may be fitted with an additional wearing part, which is of hardened or coated design. This wearing part is exchanged and replaced by a new part when wear effects occur.

In further areas of application of the invention, it has proved necessary to provide for example not only the bending-off of legs from a workpiece but also a further bending-off or bending-out of a section from the workpiece. For this purpose, it is provided in a further embodiment of the invention that the bending punch or the bending anvil is passed through by an additional bending ram, the end face of which is preferably made to match the section to be bent. In this application, it is necessary to separate the bending of the bending ram from that of the bending punch or bending anvil. If the bending ram is provided in the bending punch, it may be connected to the rest, in which case the latter should maintain, in an initial position, a certain distance from the bending punch. During lowering of the bending punch, the latter meets the workpiece and stops, while the rest can be shifted further in the direction of the bending punch against a corresponding counter pressure and consequently the distance between the two elements is eliminated. As a result, the bending ram moves out of the bending punch and executes its bending operation. Of course, this bending ram need not necessarily be arranged in the bending punch or bending anvil itself, instead it may also be located alongside the bending punch or bending anvil, that is just at the point at which the bending of the workpiece is to be carried out.

A further essential point of the invention is that the workpiece has to be positioned accurately between bending punch and bending anvil in order for the corresponding bendings to be performed by the swivel bending jaws at the previously determined points. For this purpose, it is provided according to the invention that the bending anvil is passed through by a positioning punch, which is assigned a separate hydraulic cylinder, for example a double-acting hydraulic cylinder.

With this invention, an apparatus is created by means of which a plurality of bendings can be carried out on a workpiece in a single operation. These bendings have a dimensional accuracy within a closest tolerant range, so that they satisfy the highest requirements.

Referring to FIG. 1, an apparatus P according to the invention for the bending of a workpiece 1, the initial shape of which is shown in broken lines in FIG. 1, has essentially a bending punch 2, a bending anvil 3 and swivel bending jaws 4 and 5. These swivel bending jaws 4 and 5 have in each case an axis M, about which they can be swivelled in direction x.

The sequence of movements of this apparatus P according to the invention for the bending of workpieces 1 is as follows:

The bending punch 2 is moved downward in direction z by a ram (not shown in more detail in FIG. 1) of a hydraulically driven machine. In its lower end position, it meets the workpiece 1 and clamps the latter firmly on the bending anvil 3. Thereafter, the swivel bending jaws 4 and 5 swivel upward in swivel direction x about the axes M and thus bend the left and right legs 6 and 7 of the workpiece 1, so that a U-shaped workpiece is produced.

Figure 2:
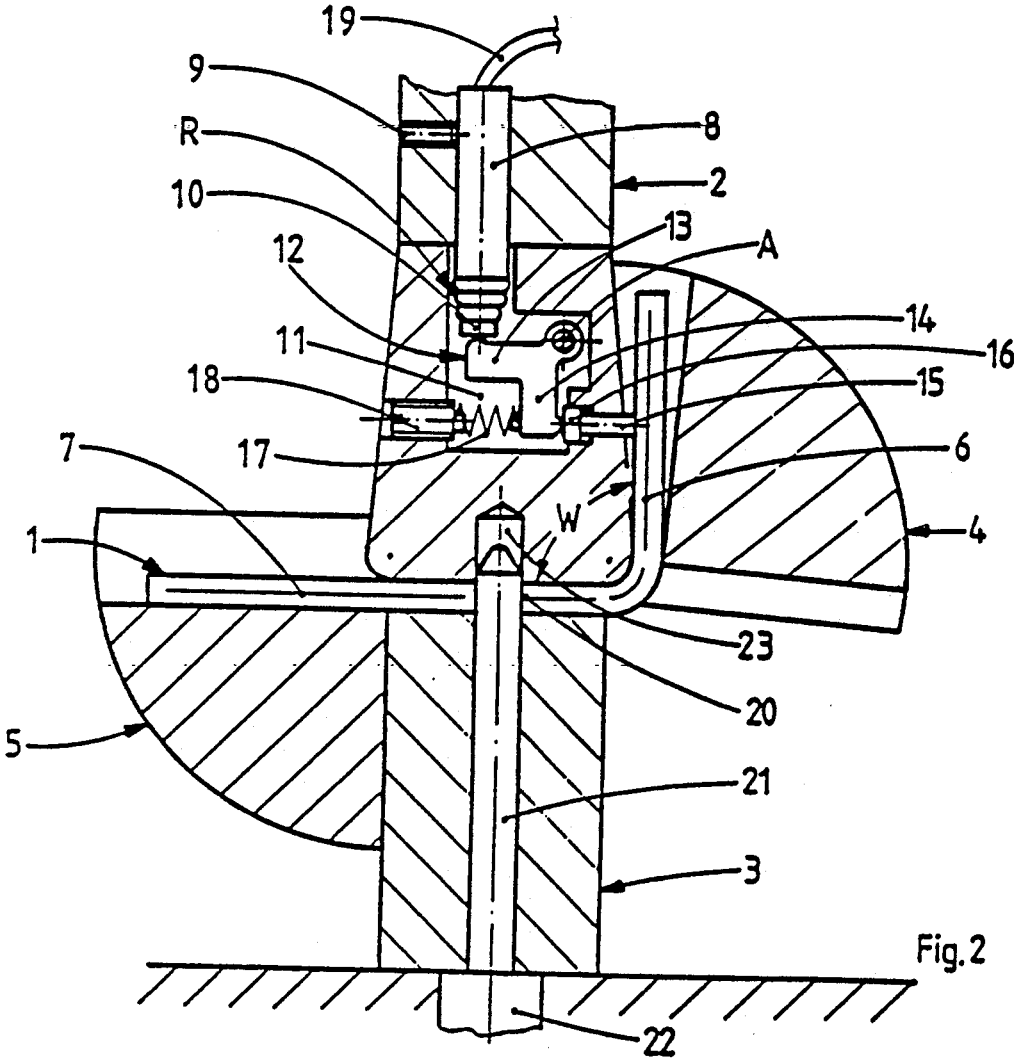
FIG. 2 shows an enlarged section through parts of the apparatus according to FIG. 1.

In FIG. 2, a cross-section through the bending punch 2 is shown, which reveals a measuring means R according to the invention for determining the bending angle.

This means R has a measuring sensor 8, which is held by means of a locking screw 9 in the bending punch 2. This measuring sensor 8 protrudes with a pushbutton 10 into a space 11 in the bending punch 2. In this space 11 there is mounted an angle lever 12, which pivots about an axis A and acts with a leg 13 on the pushbutton 10, while another leg 14 is acted upon by a measuring pin 15 or its head 16. On the other side of the head 16, the leg 14 is acted upon by a spring 17, which is arranged between the leg 14 and a stud screw 18.

In the position for use, the measuring pin 15 strikes against the bent leg 6 of the workpiece 1 and can accordingly determine the actual value of the bending angle w. A change in the bending angle w acts via the measuring pin 15 on the leg 14 of the angle lever 12, so that this change is also transferred to the leg 13, which acts on the pushbutton 10 of the measuring probe 8. This measured value of the bending angle w is input via a corresponding line 19 to a computer, described further below, and evaluated there.

The means R may also, however, consist of an electronic or optical measuring sensor, which instead of the measuring pin determines the bending angle w directly. Furthermore, the measuring probe 8 may also be used directly instead of the measuring pin. Here the invention is not to be set any limit. For positioning of the workpiece 1, the latter has in the present case, according to FIG. 2, a borehole 20, through which a positioning punch 21 can be led. The activation of the positioning punch 21 is performed, for example, via a double-acting hydraulic cylinder unit 22, which is only shown partly in FIG. 2.

The positioning punch 21 may, moreover, have any shape, the borehole 20 then having to be adapted correspondingly. In the exemplary embodiment shown, punch 21 passes through the borehole 20 into a blind hole 23 in the end face of the bending punch 2.

It goes without saying that a means R, described above, for determining the bending angle in the bending punch 2 is also provided for the second leg 7 of the workpiece 1.

The feeding and placing of the workpiece onto the bending anvil 3 is performed by a sheet bar feeding unit (not shown in more detail), the flat workpiece 1 being seized, for example, by a tongue, a sucker or magnet and removed fully automatically from a stack magazine. Which type of feed unit is employed in a particular individual case depends on the material of the workpiece, its thickness, its shape and its weight.

The bent workpiece is likewise removed from the apparatus P by a part-removing unit and laid down, preferably positioned in place, in order not to damage the dimensionally accurate bent workpiece.

Figure 3:
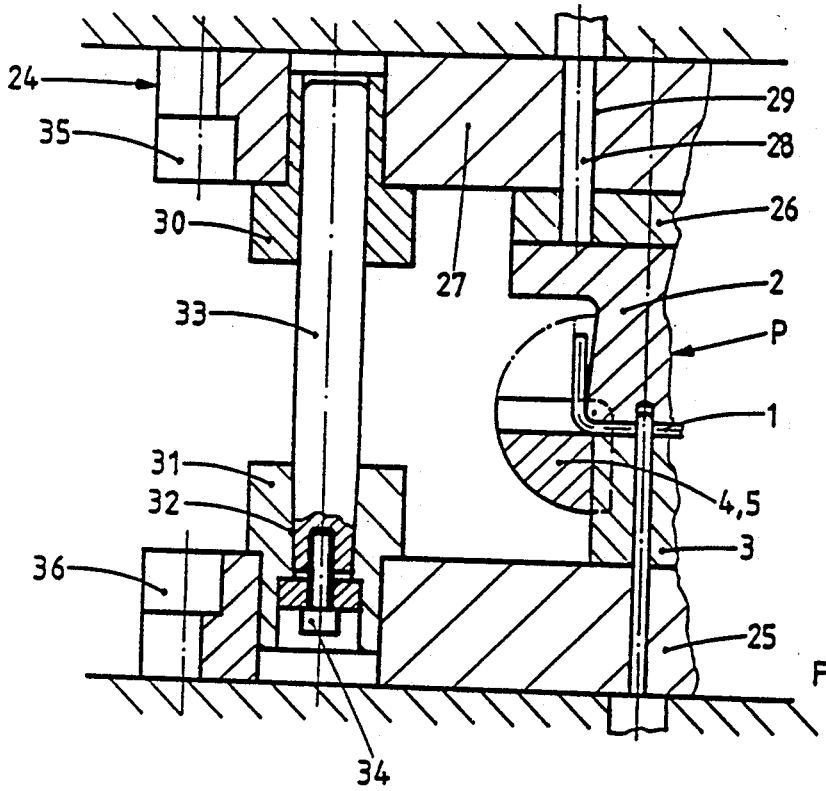
FIG. 3 shows a reduced section of a mirror-symmetrical half of the overall apparatus for the bending of workpiece.

The apparatus P for the bending of workpieces is preferably arranged in a post jig 24 (see FIG. 3). With this post jig 24, the bending punch 2 and the bending anvil 3 can be positioned accurately together with the swivel bending jaws 4 and 5, in order for the reception of the workpiece 1 to be ensured.

For example, such a post jig 24 may consist of a lower block 25, on which the bending anvil 3 is seated. The bending punch 2 is supported on the other hand via a rest 26 against an upper block 27. The bending punch 2 is acted upon by a thrust bolt 28 of a hydraulic drive (not shown in more detail) for the lowering of the bending punch 2. The longitudinal boreholes 29 serve to receive the thrustbolt 28 described.

Both in the upper block 27 and in the lower block 25 there are guide bushes 30 and 31, respectively, sunken in, the lower guide bush 31 having a conical receptacle 32 for a correspondingly shaped end of a guide post 33, the guide post 33 being held in the guide bush 31 by a corresponding screw 34. With the other end, the guide post 33 slides in the guide bush 30 of the upper block 27, fixing elements (not shown in more detail) being provided, by means of which a predetermined distance can be established and fixed between bending punch 2 and bending anvil 3. Corresponding block fastenings are indicated at 35 and 36.

Figure 4:
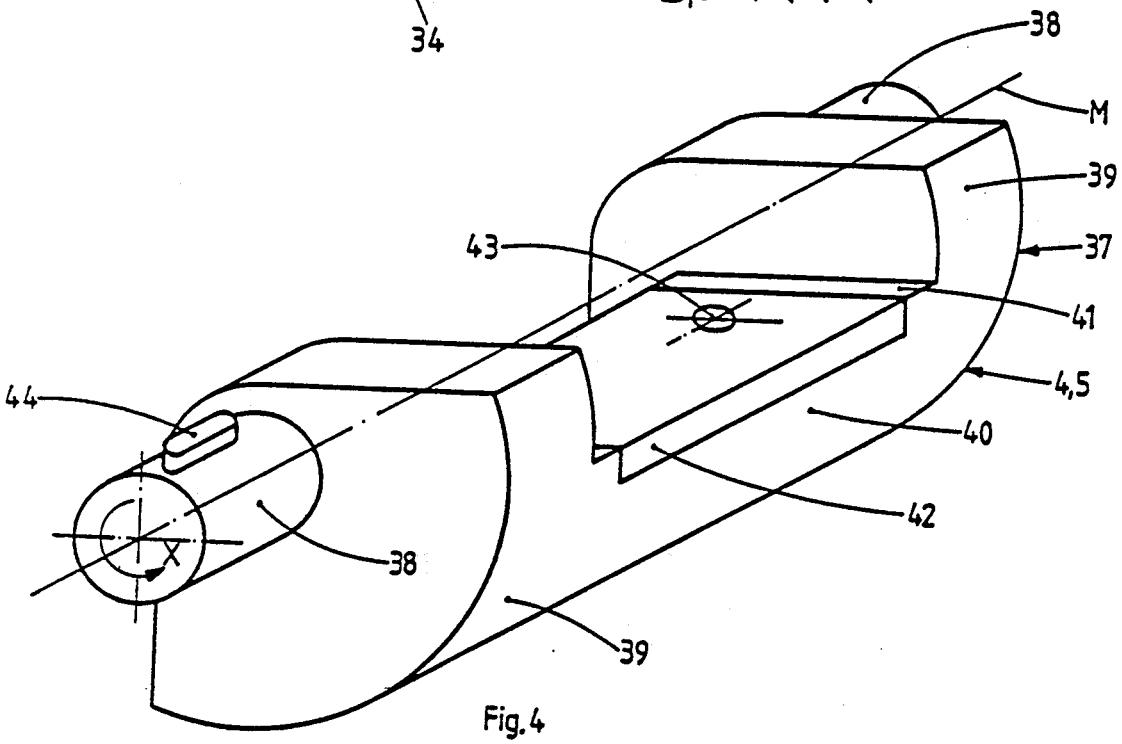
FIG. 4 shows a perspective view of an enlarged swivel bending jaw according to the invention.

The swivel bending jaw 4/5, shown in FIG. 4, has a jaw body 37, from which stub shafts 38 protrude on both sides. The longitudinal axis of the stub shafts 38 at the same time forms the axis M, about which the swivel bending jaws 4/5 turn in swivel direction x. With low bending forces, a single-sided mounting also suffices.

Between two circular segment-shaped supports 39 there is provided a guide surface 40, which forms together with the supports 39 a receiving channel 41 for the leg 6 or 7 of the workpiece 1. The base of the receiving channel 41 is in this case shaped out from a wearing part 42, which is sunken into the guide surface 40 and is fixed by means of corresponding fastening elements 43. Depending on use, the wearing part 42 may be hardened or specially coated or otherwise treated.

Figure 5:
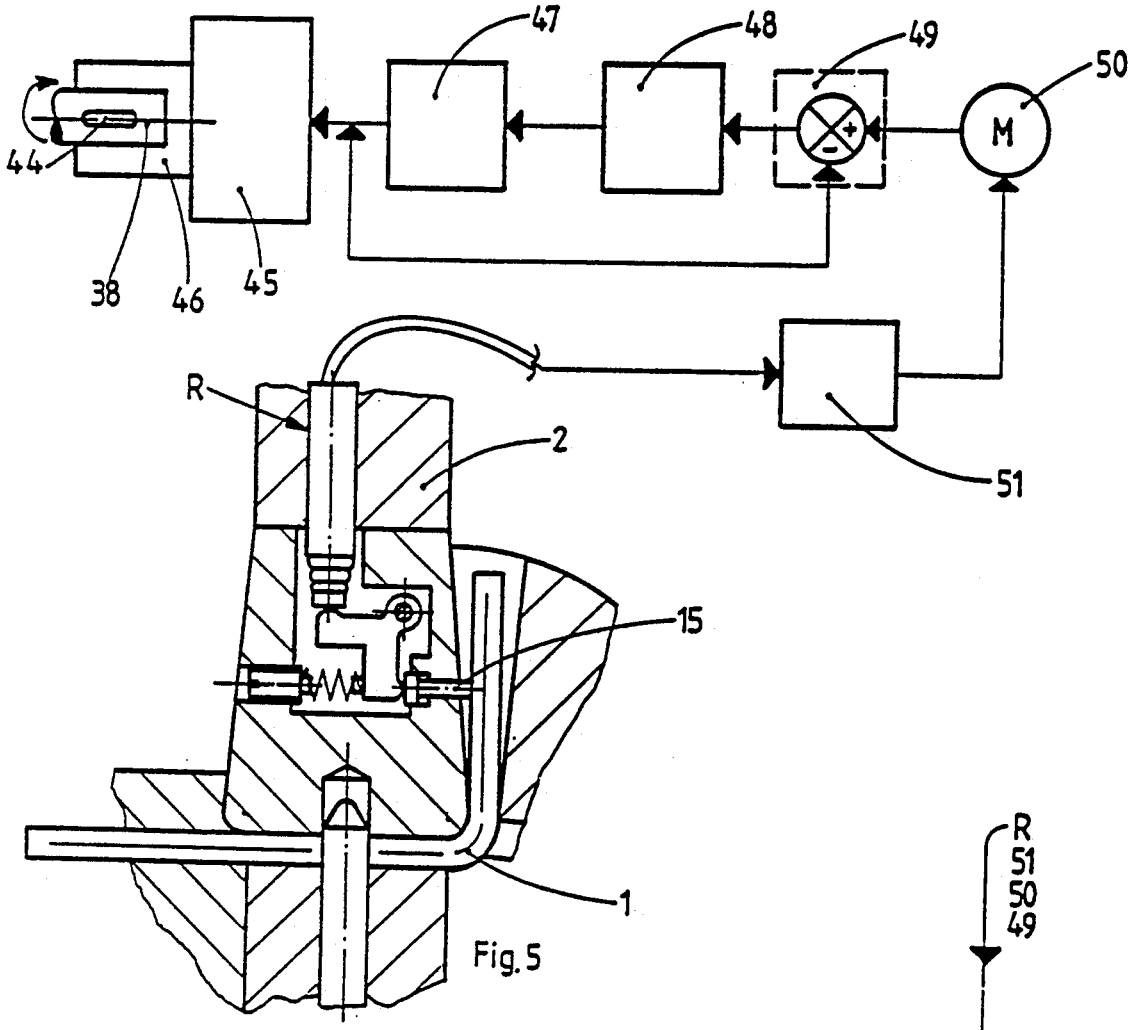
FIG. 5 shows a block circuit diagram having elements, in some cases shown in cross-section, of a measuring and control unit for the apparatus according to the invention according to FIG. 1.

On one stub shaft 38 there is also an adjusting spring 44 provided, for the transfer of a drive torque, which effects the movement of the swivel bending jaw 4/5 in swivel direction x. Various types of drive are conceivable here, according to FIGS. 5 to 7. In FIG. 5, a gear 45 is diagrammatically represented, a gear output shaft being connected via a corresponding coupling 46 directly to the stub shaft 38 via the adjusting spring 44. Coupled to the gear 45 is a drive, which is intended in the present exemplary embodiment to be an electrohydraulic torque amplifier. This electrohydraulic torque amplifier is commercially available and consists of a hydraulic motor 47, an NC valve 48, a control slide valve 49 and a pilot motor 50. The connection to a computer 51 of a control logic is performed via the pilot motor 50, which control logic also receives the measuring pulses of the means R for determining the bending angle w. In this computer 51, the actual value of the bending angle w, determined by means of the measuring pin 15, is compared with a desired set value. Thereafter, the gear 45 is addressed via the electrohydraulic torque amplifier 47–50 and a rebending is carried out via the swivel bending jaws 4 and 5 to correct the bending angle w.

According to the invention, one idea is that each bending jaw 4 and 5 has its own such drive. If, however, a same bending of the workpiece 1 is to be performed on both sides, it is also possible to interconnect the two swivel bending jaws 4 and 5 via corresponding gear elements, such as gear wheels, toothed racks, universal joints or the like, so that they execute the same bending movement exactly.

Figure 6:
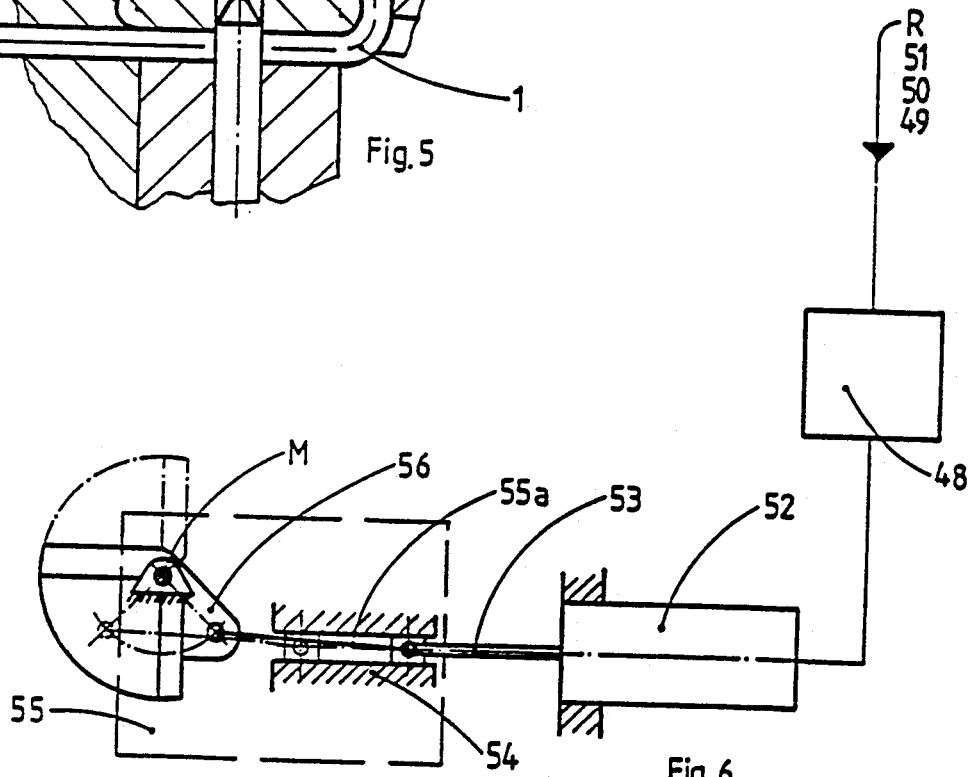
FIG. 6 shows a further exemplary embodiment of a drive for a swivel bending jaw.

In an exemplary embodiment of a swivel bending jaw drive according to FIG. 6, the hydraulic motor is replaced by a hydraulic cylinder 52. Consequently, in the case of this exemplary embodiment, an electrohydraulic linear amplifier, likewise commercially available, is used, which has not only the hydraulic cylinder 52 and the NC valve 48 but likewise a control slide valve 49 and a pilot motor 50.

The piston rod 53 of the hydraulic cylinder 52 engages in a connecting link 54 of a lever gear 55, only indicated diagrammatically. This lever gear 55 passes the force of the hydraulic cylinder 52 via the connecting link 54 and the connecting rod 55*a*, guided by means of a lever 56, directly onto the swivel axis M.

Such a drive via an electrohydraulic linear amplifier is employed when large bending forces are necessary, since virtually unlimited forces can be applied to the swivel bending jaws 4/5 through the hydraulic cylinder diameter.

In the case of this swivel bending jaw drive as well, each swivel bending jaw 4/5 may be driven individually in order to bring each leg of the workpiece into a desired angular position.

In the case of workpieces whose legs have the same bending cross-sections, bending radii, bending angles and the same leg lengths, the drive on one swivel bending jaw 4 or 5 suffices however, the second swivel bending jaw then being driven synchronously via a pair of gear wheels. In this case, helically toothed spur gears are best suited. For highest accuracy, spur gears with herringbone toothing are employed.

As far as the NC valve 48 is concerned, it should also be noted that it controls either the hydraulic cylinder 52 or the hydraulic motor 47, receiving its pressure oil preferably from the hydraulic system integrated in the apparatus P.

Figure 7:
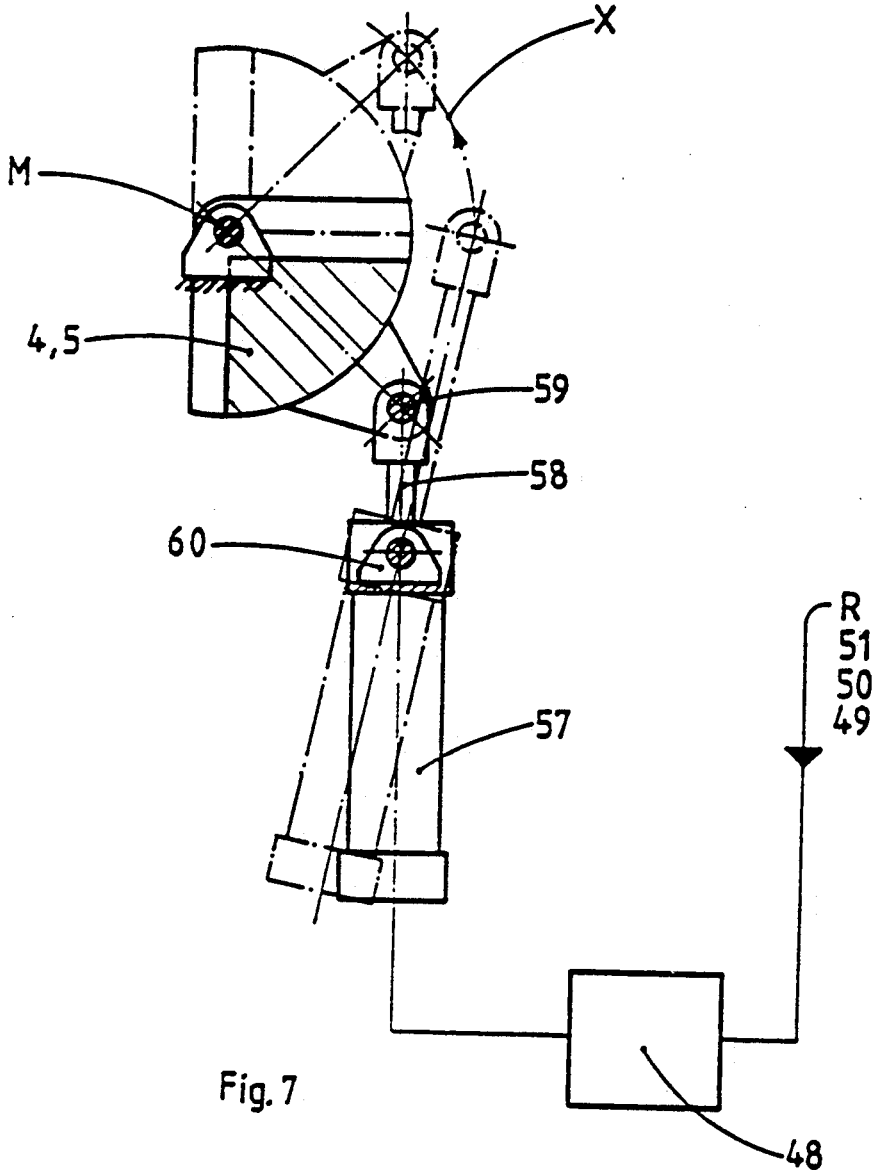
FIG. 7 shows a further exemplary embodiment of a drive for a swivel bending jaw.

In FIG. 7, a drive for the swivel bending jaws 4 and 5 is shown, which acts directly on the swivel bending jaws 4 and 5. For this purpose, an electrohydraulic linear amplifier 57 is provided, which is coupled via a piston rod 58 directly to a bolt 59 on the swivel bending jaw 4/5. In order to be able to follow the circular movement of the bolt 59 in direction x, the cylinder 57 is arranged in a swivelling manner about a swivel bearing 60.

Furthermore, there is also the idea of coupling the stub shaft 38 to a purely electric stepping motor, for example in the case of small necessary torques. Here the invention is set no limits.

Figure 8:
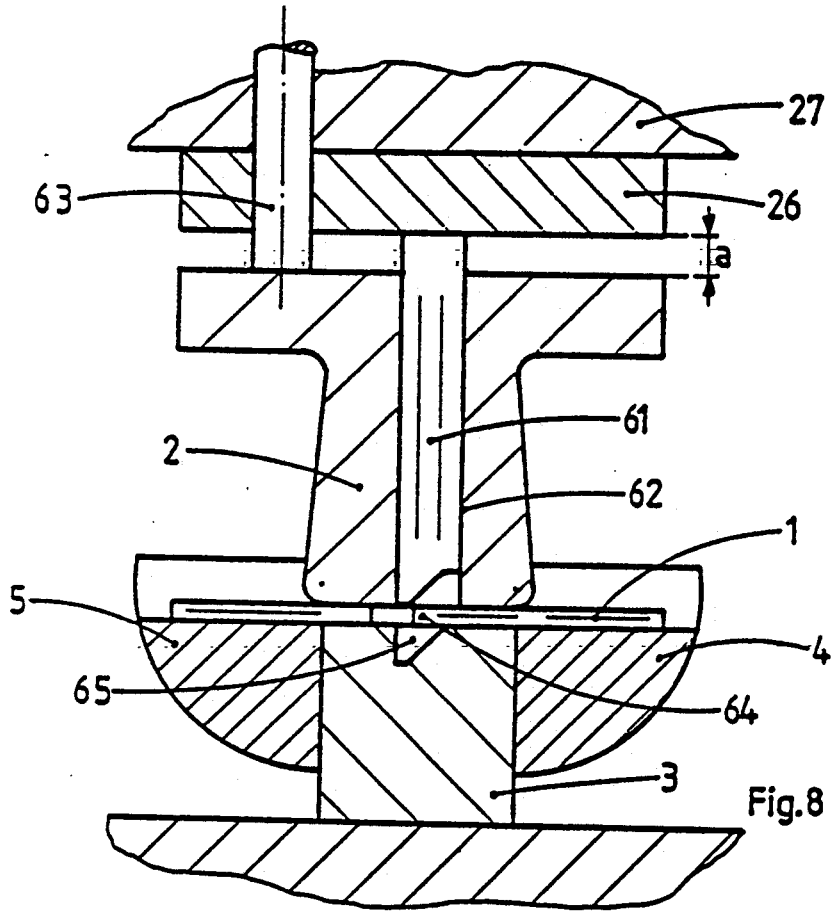
FIGS. 8 to 11 show a diagrammatic representation of the sequence of movements according to the invention during the bending of a workpiece.

In FIGS. 8 to 11, a sequence of movements for the bending of a workpiece is illustrated, a triple bending being performed here. In FIG. 8, the position in which the bending punch 2 is already seated on the workpiece 1 and presses it against the bending anvil 3 is indicated.

In this case, the workpiece 1 i$ already positioned, as is shown in FIG. 2.

In this exemplary embodiment, however, there is maintained between the bending punch 2 and its rest 26 a predetermined variable distance a, which is dimensioned such that a bending ram 61, which protrudes from the rest 26 and passes through an axial borehole 62 of the bending punch 2 is drawn into the said borehole.

Figure 9:
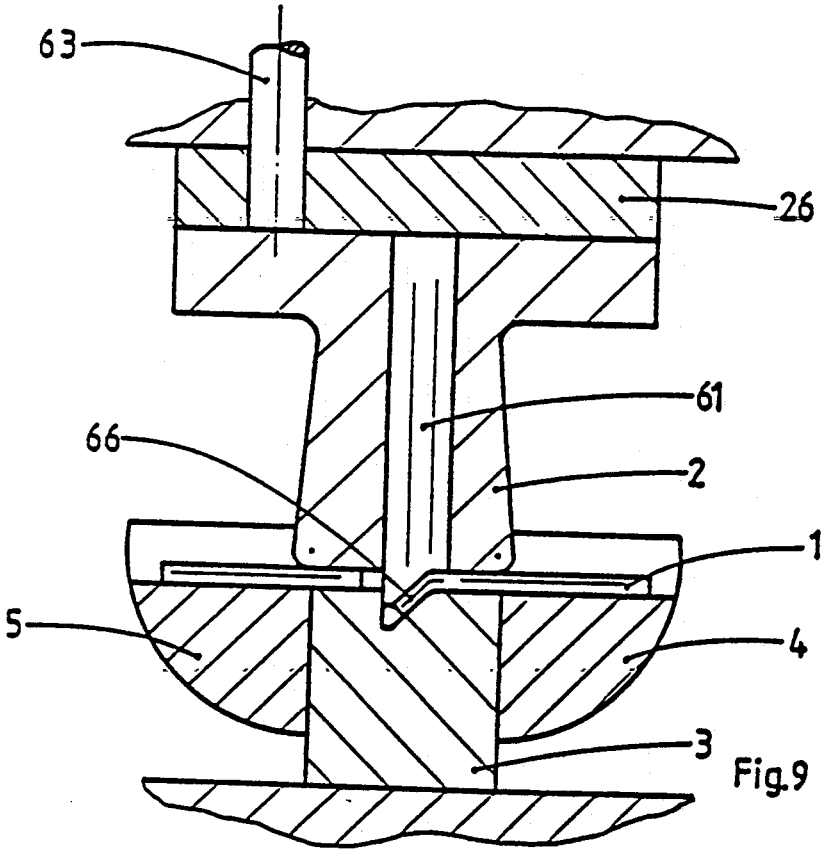

During the lowering of this complete upper tool, which here also consists of the upper block 27, the rest 26, a thrust bolt 63, the bending punch 2 and the bending ram 61, the bending punch 2 first meets the workpiece 1. Thereupon, the bending punch 2 stops, while the rest 26 continues to move. In this process, the hydraulic system of the drive ram (not shown) (clamping force) is displaced upward by means of the thrust bolt 63, the bending ram 61 continuing to move relative to the bending punch 2 and the distance a being eliminated. A defined section 64 of the workpiece 1 is bent off by the bending ram 61 into a corresponding recess 65 of the bending anvil 3, the contour 66 of the ram end face preferably being adapted to the desired bending of the section 64. This working position is shown in FIG. 9.

Figure 10:
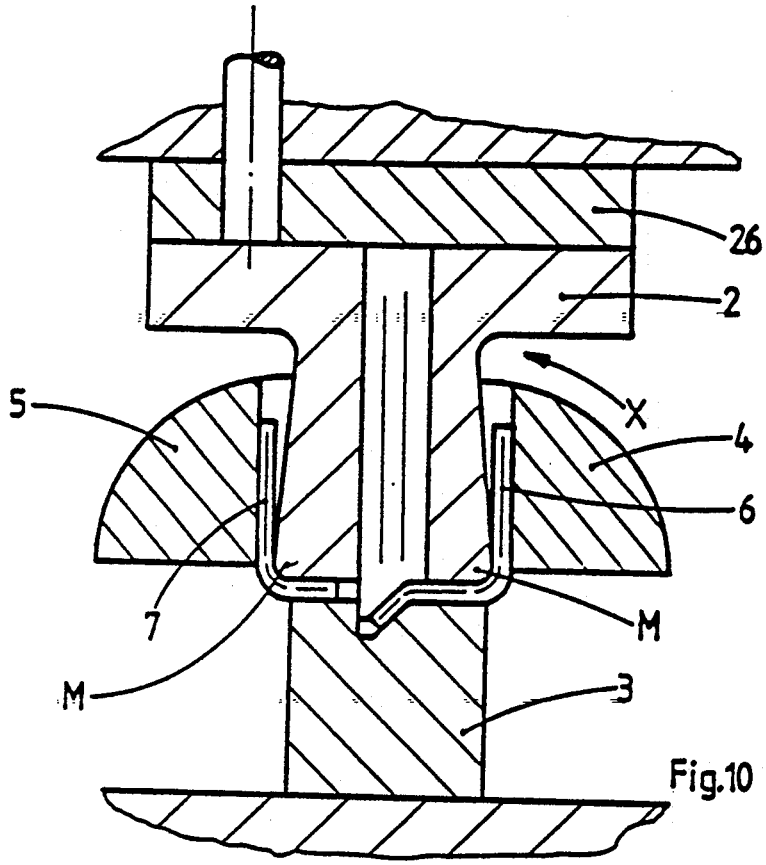
Figure 11:
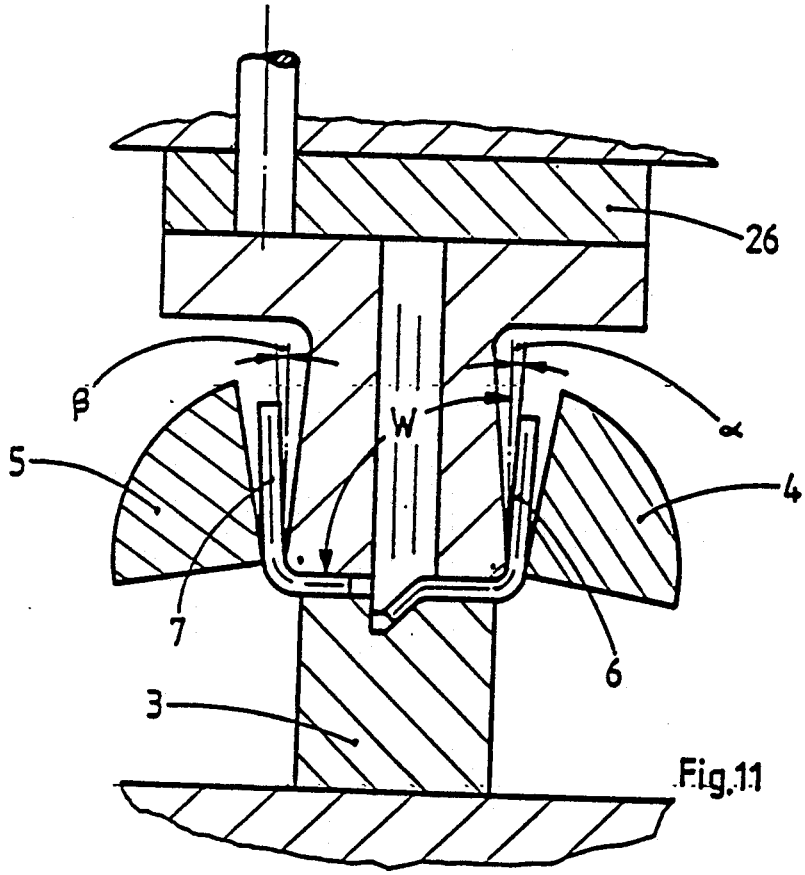

According to FIG. 10, the swivel bending jaws 4 and 5 are then moved about their corresponding axis M in swivel direction x. Although the conical profile of the bending punch 2 makes a bending-over of the legs 6 and 7 through 90° possible, it should only be performed in exceptional cases during the first bending of the legs 6 and 7.

With a desired set value of the bending angle w, the first bending should only be performed up to this set value. This avoids a bending-over even exceeding the desired set value being performed straight away in the first bending, something which cannot be reversed by means of the apparatus according to the invention.

In the case of the example, a bending angle w of 90° is desired. In this case, the swivel bending jaws 4 and 5 are also only swivelled by 90° during the first bending. Thereafter, an opening of the swivel bending jaws 4 and 5 by about 5° is performed, so that the legs 6 and 7 are released. The latter spring back into an achieved bending position, the actually achieved bending angle w being determined via the measuring pins 15 (not shown for the sake of clarity). The computer 51 can then determine the difference $\alpha$ and $\beta$, respectively, between the actually achieved bending angle w and the set bending angle. In the computer 51 there is, however, also a corresponding conversion program, via which it can be determined to which degree the leg 6 or 7 has to be bent over during a second bending operation in order to make up for the respective springback $\alpha$ and $\beta$. Consequently, in the second bending, this springback is corrected exactly and the desired bending angle w is achieved. Of course, this second bending operation may also be remeasured by the measuring pins 15 and once again compared with the set value. However, it has been found in practice that a second measurement is generally no longer necessary, but that the apparatus according to the invention already achieves a highest possible degree of accuracy with the second bending operation.

Then, the swivel bending jaws 4 and 5 swing back into their initial position and the hydraulic ram (not shown) runs upward. In this process, first the bending ram 61 moves into its axial borehole 62, the distance a between the rest 26 and bending punch 2 being restored. Only then does the complete upper tool move away upward. The bent workpiece 1 remains on the bending anvil 3 and is removed from the bending anvil 3 by means of a corresponding part-removing unit.

The measuring system is, moreover, designed such that a quality control card can also be printed out for each bent workpiece or a workpiece series, so that the bending accuracy is demonstrated to the user.

I claim:

1. Apparatus for bending a workpiece by swivel bending jaws wherein the bent portion assumes a predetermined bending angle with respect to the workpiece, which comprises: a bending anvil; a bending punch spaced from the bending anvil and movable towards and away from the bending anvil; at least one swivel bending jaw associated with the bending anvil and movable in the direction of the bending punch; wherein the bending anvil, bending punch and swivel jaw are adapted to hold a workpiece between the bending anvil on the one hand and bending punch and swivel jaw on the other hand and wherein the swivel jaw is adapted to bend at least one first leg of the workpiece in the direction of the bending punch; and means in the bending punch for determining the actual bending angle of the bent leg by direct measurement of the distance between the bending punch and the bent leg of the workpiece.

2. Apparatus according to claim 1 wherein the means in the bending punch detects the position of the bent leg directly and is selected from the group consisting of an electronic measuring probe, an optical measuring probe and a mechanical measuring probe.

3. Apparatus according to claim 1 wherein the means in the bending punch for determining the bending angle has a measuring pin which can be led against the bent leg of the workpiece.

4. Apparatus according to claim 3 including a measuring probe for detecting the movement of the measuring pin.

5. Apparatus according to claim 1 including a post jig for holding and positioning the bending punch, bending anvil and said at least one swivel bending jaw.

6. Apparatus according to claim 5 including a raiseable and lowerable block connected to said bending punch and guide bushes and guide posts for guiding said block.

7. Apparatus according to claim 1 wherein the swivel bending jaw has a jaw body which swivels about an axis, and at least one stub shaft provided in the line of the axis, and a drive connected via a gear to at least one stub shaft.

8. Apparatus according to claim 7 wherein the drive is an electrically driven stepping motor which is connected directly to the shaft.

9. Apparatus according to claim 7 wherein the drive is connected to a computer which also has a connected to the means for determining the bending angle.

10. Apparatus according to claim 1 wherein the swivel bending jaw has a jaw body and wherein the jaw body consists of two lateral supports which form a guide surface between them and wherein the guide surface is formed in lowered position between the two supports and forms a receiving channel.

11. Apparatus according to claim 10 wherein the guide surface is fitted with a wearing part.

12. Apparatus according to claim 11 wherein the wearing part is hardened or coated.

13. Apparatus according to claim 1 wherein the means in the bending punch for determining the actual bending angle is operative to compare the actual bending angle with a set bending angle.

14. Apparatus according to claim 13 wherein said swivel jaw is adapted to bend at least one first leg of the workpiece in at least two bending operations to establish agreement between the set bending angle and the actual bending angle.

15. Apparatus for bending a workpiece by swivel bending jaws wherein the bent portion assumes a predetermined bending angle with respect to the workpiece, which comprises: a bending anvil; a bending punch spaced from the bending anvil and movable towards and away from the bending anvil; at least one swivel bending jaw associated with the bending anvil and movable in the direction of the bending punch; wherein the bending anvil, bending punch and swivel jaw are adapted to hold a workpiece between the bending anvil on the one hand and bending punch and swivel jaw on the other hand and wherein the swivel jaw is adapted to bend at least one first leg of the workpiece in the direction of the bending punch; and means in the bending punch for determining the actual bending angle of the bent leg by direct measurement of the distance between the bending punch and the bent leg of the workpiece, said means including a measuring pin which can be led against the bent leg of the workpiece and a measuring probe for detecting the movement of the measuring pin; and an angle lever having two legs, said angle lever pivoting about an axis arranged between the measuring pin and measuring probe, wherein a first lever leg acts on the measuring probe and a second lever leg is acted upon by the measuring pin.

16. Apparatus according to claim 15 including a spring supporting the second lever leg at the end thereof opposed to the measuring pin.

17. Apparatus for bending a workpiece by swivel bending jaws wherein the bent portion assumes a predetermined bending angle with respect to the workpiece, which comprises: a bending anvil; a bending punch spaced from the bending anvil and movable towards and away from the bending anvil; at least one swivel bending jaw associated with the bending anvil and movable in the direction of the bending punch; wherein the bending anvil, bending punch and swivel jaw are adapted to hold a workpiece between the bending anvil on the one hand and bending punch and swivel jaw on the other hand and wherein the swivel jaw is adapted to bend at least one first leg of the workpiece in the direction of the bending punch; and means in the bending punch for determining the actual bending angle of the bent leg by direct measurement of the distance between the bending punch and the bent leg of the workpiece; a drive for the at least one swivel bending jaw consisting of an electrohydraulic torque amplifier.

18. Apparatus according to claim 17 wherein the electrohydraulic torque amplifier includes a hydraulic motor, an NC valve, a control slide valve and a pilot motor.

19. Apparatus for bending a workpiece by swivel bending jaws wherein the bent portion assumes a predetermined bending angle with respect to the workpiece, which comprises: a bending anvil; a bending punch spaced from the bending anvil and movable towards and away from the bending anvil; at least one swivel bending jaw associated with the bending anvil and movable in the direction of the bending punch; wherein the bending anvil, bending punch and swivel jaw are adapted to hold a workpiece between the bending anvil on the one hand and bending punch and swivel jaw on the other hand and wherein the swivel jaw is adapted to bend at least one first leg of the workpiece in the direction of the bending punch; and means in the bending punch for determining the actual bending angle of the bent leg by direction measurement of the distance between the bending punch and the bent leg of the workpiece; wherein the swivel bending jaw swivels about an axis, a stub shaft in the line of the axis and including a drive for the swivel bending jaw about said axis consisting of an electrohydraulic linear amplifier connected to the stub shaft.

20. Apparatus according to claim 19 wherein the electrohydraulic linear amplifier consists of a hydraulic cylinder, an NC valve, a control slide valve and a pilot motor.

21. Apparatus according to claim 20 wherein a piston rod from the electrohydraulic linear amplifier enters into a connecting link of a lever gear and acts via a lever on the axis or the stub shaft.

22. Apparatus for bending a workpiece by swivel bending jaws wherein the bent portion assumes a predetermined bending angle with respect to the workpiece, which comprises: a bending anvil; a bending punch spaced from the bending anvil and movable towards and away from the bending anvil; at least one swivel bending jaw associated with the bending anvil and movable in the direction of the bending punch; wherein the bending anvil, bending punch and swivel jaw are adapted to hold a workpiece between the bending anvil on the one hand and bending punch and swivel jaw on the other hand and wherein the swivel jaw is adapted to bend at least one first leg of the workpiece in the direction of the bending punch; and means in the bending punch for determining the actual bending angle of the bent leg by direction measuring of the distance between the bending punch and the bent leg of the workpiece; wherein the swivel bending jaw has a jaw body, an electrohydraulic linear amplifier acting directly on the jaw body, a piston rod of the electrohydraulic linear amplifier connected to the jaw body and a cylinder mounted in a swiveling manner on a swivel bearing.

23. Apparatus for bending a workpiece by swivel bending jaws wherein the bent portion assumes a predetermined bending angle with respect to the workpiece, which comprises: a bending anvil; a bending punch spaced from the bending anvil and movable towards and away from the bending anvil; at least one swivel bending jaw associated with the bending anvil and movable in the direction of the bending punch; wherein the bending anvil, bending punch and swivel jaw are adapted to hold a workpiece between the bending anvil on the hand and bending punch and swivel jaw on the other hand and wherein the swivel jaw is adapted to bend at least one first leg of the workpiece in the direction of the bending punch; and means in the bending punch for determining the actual bending angle of the bent leg by direct measurement of the distance between the bending punch and the bent leg of the workpiece; a bending ram associated with the bending anvil for bending of a further section of the workpiece.

24. Apparatus according to claim 23 including an axial borehole in one of the bending punch and bending anvil and a recess in the other of said bending punch and bending anvil, wherein the bending ram passes through the axial borehole and, in the position of use, enters into said recess taking with it the bent further section.

25. Apparatus according to claim 24 including a rest, wherein the bending ram is connected to the rest and wherein the bending ram maintains in an initial position a defined variable distance from one of the bending punch and bending anvil, so that the bending ram is withdrawn into the axial borehole.

26. Apparatus according to claim 25 wherein the variable distance is variable against the clamping force of a thrust bolt.

27. Apparatus for bending a workpiece by swivel bending jaws wherein the bent portion assumes a predetermined bending angle with respect to the workpiece, which comprises: a bending anvil; a bending punch spaced from the bending anvil and movable towards and away from the bending anvil; at least one swivel bending jaw associated with the bending anvil and movable in the direction of the bending punch; wherein the bending anvil, bending punch and swivel jaw are adapted to hold a workpiece between the bending anvil on the one hand and bending punch and swivel jaw on the other hand and wherein the swivel jaw is adapted to bend at least one first leg of the workpiece in the direction of the bending punch; and means in the bending punch for determining the actual bending angle of the bent leg by direction measurement of the distance between the bending punch and the bent leg of the workpiece; including at least one positioning punch engaging the workpiece, wherein the bending anvil is passed through by said positioning punch whereby the positioning of the workpiece is achieved.

28. Apparatus according to claim 27 wherein the positioning punch is connected to a double-acting hydraulic cylinder.

* * * * *